United States Patent [19]

Wiggins

[11] 4,042,734

[45] Aug. 16, 1977

[54] METHOD FOR SPRAY COATING

[75] Inventor: Richard F. Wiggins, Fairfield, Conn.

[73] Assignee: The Gyromat Corporation, Stratford, Conn.

[21] Appl. No.: 637,019

[22] Filed: Dec. 2, 1975

[51] Int. Cl.[2] ..... B05D 1/02

[52] U.S. Cl. ..... 427/424

[58] Field of Search ..... 427/424

[56] References Cited

U.S. PATENT DOCUMENTS

| | | | |
|---|---|---|---|
| 2,848,353 | 8/1958 | Norris | 427/345 |
| 3,386,415 | 6/1968 | Faber | 118/323 |
| 3,568,638 | 3/1971 | Isaac | 118/323 |
| 3,619,311 | 11/1971 | Rose et al. | 427/424 X |

*Primary Examiner*—James R. Hoffman

*Attorney, Agent, or Firm*—Mandeville and Schweitzer

[57] ABSTRACT

The disclosure is directed to a method and apparatus for spray painting of large, irregularly shaped articles, where the shape and size of the articles require relative movement between the article and the spray applicator in at least two axes. One, and preferably a plurality of atomizing nozzles are arranged to be rotated about a predetermined axis and are oriented at a substantial angle to such axis. The article to be coated is conveyed past the spray station along one axis, and the rotating spray unit is reciprocated along a second axis at right angles to said axis of conveyance. The orientation and positioning of the atomizing heads is such that the spray fans intercept the primary work surfaces relatively close to the intersection therewith of the axis of spray head rotation. In addition, the rate of spray head rotation is so controlled, in relation to the rate of reciprocation and the rate of conveyance that the spray fans of coating material describe a path in the nature of a tight prolate cycloid. During rotation of the angled spray heads, the various surfaces of an irregularly shaped article are directly exposed to the spray heads and are thoroughly coated.

17 Claims, 11 Drawing Figures

METHOD FOR SPRAY COATING

BACKGROUND AND SUMMARY OF THE INVENTION

Spray painting of irregularly shaped articles by atuomatic production means presents a substantial problem in achieving an adequately uniform coating of the workpiece surfaces. When utilizing non-electrostatic spray coating techniques, the automatic spray coating of a part having a variety of surface exposures may require a complex initial setup of the spray heads, to direct sprays from various angles and in various directions, in order to be assured of applying coating material to all of the surface exposures. In this respect, it will be understood that, with non-electrostatic spray techniques, surfaces must be "seen" by the spray head, in order to be coated.

Where a long production run of identical parts is to be spray coated, extensive and complex setups may be justified, in order to effectively utilize non-electrostatic spray coating techniques. However, where workpieces of a variety of sizes and shapes must be accommodated in the spray coating system, it may not be practical or economically justified to utilize complex nozzle arrangements, requiring significant setup time. In such cases, it may be necessary to spray the primary surface with an automatic system and, in addition, to resort to extensive manual touch up in order to complete the job.

For some applications, electrostatic spray coating techniques may be utilized in order to take advantage of the "wrap around" effect of the electrostatically attracted paint particles. However, electrostatic coating techniques themselves have important limitations, particularly in connection with extremely irregular workpieces. The electrostatic wrap around effect is relatively limited in nature, and does not obviate the need for special setup of the spray head for reaching deep recesses and other difficult-to-reach surfaces.

The present invention provides a unique method and apparatus for achieving a highly satisfactory spray coating of irregular workpieces which, within practical limits, is able to process workpieces of extremely large size, having surface areas exposed along the various axis. Pursuant to the invention, one or more spray heads is mounted for rotary movement about a predetermined axis. The spray head or heads are in turn disposed at a substantial angle to the rotational axis (typically around 45°) such that, when the spray heads are rotated about a horizontal axis (for example) the spray fans emanating from the spray heads will, at one time or another, traverse most surfaces which are either in front of, above or below, or to either side of the rotating spray heads. In an automatic spray coating line, the workpiece to be coated is conveyed through a spray coating chamber past a coating station at which the rotating spray heads are located. Pursuant to the invention, the spray heads are reciprocated more or less at right angles to the path or axis along which the workpiece is conveyed, so that the rotating nozzles sweep the work from end to end and also from top to bottom.

According to one aspect of the invention, predetermined relationships are maintained between the average radius of the spray fan intercept relative to the axis of rotation, the rate of rotation of the nozzles, and the relative translation thereof which occurs as a result of the combined effects of horizontal conveying of the workpiece and vertical reciprocation of the rotating spray nozzles, such that the path described by the spray fans, as applied to a flat surface normal to the rotating axis, is a tightly closed prolate cycloid. Inasmuch as the path described by the rotating nozzles is relatively complex, it is significant to the process that there be an appropriate correlation of angle of spray nozzle orientation, spacing of spray nozzles from the work, rate of rotation of the nozzles and rate of relative translation thereof, in order to achieve the desired path of spray application. Where the proper relationships are not observed, spray coating application on the workpiece surfaces may be highly irregular and of unsuitable quality.

Although rotary motion of the angularly disposed spray heads is a significant aspect of the invention, the rotary motion need not be continuous and unidirectional, but may be of a oscillatory nature. Utilizing a pair of nozzles rotating about a common axis, for example, it may be advantageous to rotate the assembly for 180° in one direction and then 180° back in the opposite direction. This has certain practical advantages in eliminating the need for rotating seals, which can be difficult to maintain in a painting system. It also has the effect of reversing the orientation of the cycloidal curve with each reversal of direction of rotation of the nozzles. Regardless, however, of whether the nozzle rotation is undirectional or reciprocating, the various abovementioned geometric relationships are so adjusted and related that the ratio of the mean diameter of the spray application path to the diameter of the "equivalent" rolling circle is at least about five to one, in order to generate the desired, tightly closed prolate cycloid coating path.

Although the invention may not be exclusively limited to such utilization, it is extraordinarly advantageous when used in conjuction with a recirculating overspray recovery system of the general type described in the E. O. Norris U.S. Pat. No. 2,848,353. With this system, the spray material may be applied substantially without regard to the amount of overspray (spray material not contacting the workpiece) inasmuch as such spray material is collected and recycled. The combination of the rotating, reciprocating spray heads, as above described, in conjunction with the recirculating and overspray collection system, is outstandingly advantageous for the spray coating of workpieces in which there is a considerable amount of open work, for example, or where the general configuration of the part is highly irregular from place to place such that a reciprocating stroke adequate for some portions of the workpiece would tend to be excessive for others. Particularly in the spray coating of open truss work, for example, the spray nozzle are necessarily spraying into open air a substantial percentage of the time. In such cases, in the absence of a recirculating overspray collection system, the economics of automatic spray coating might be prohibitive, notwithstanding the highly superior quality of the coating results achieved.

For a better understanding of the above and other features and advantages of the invention, reference should be made to the following detailed description and to the accompanying drawings.

DESCRIPTION OF THE PREFERRED EMBODIMENTS OF THE INVENTION

Figure 1:
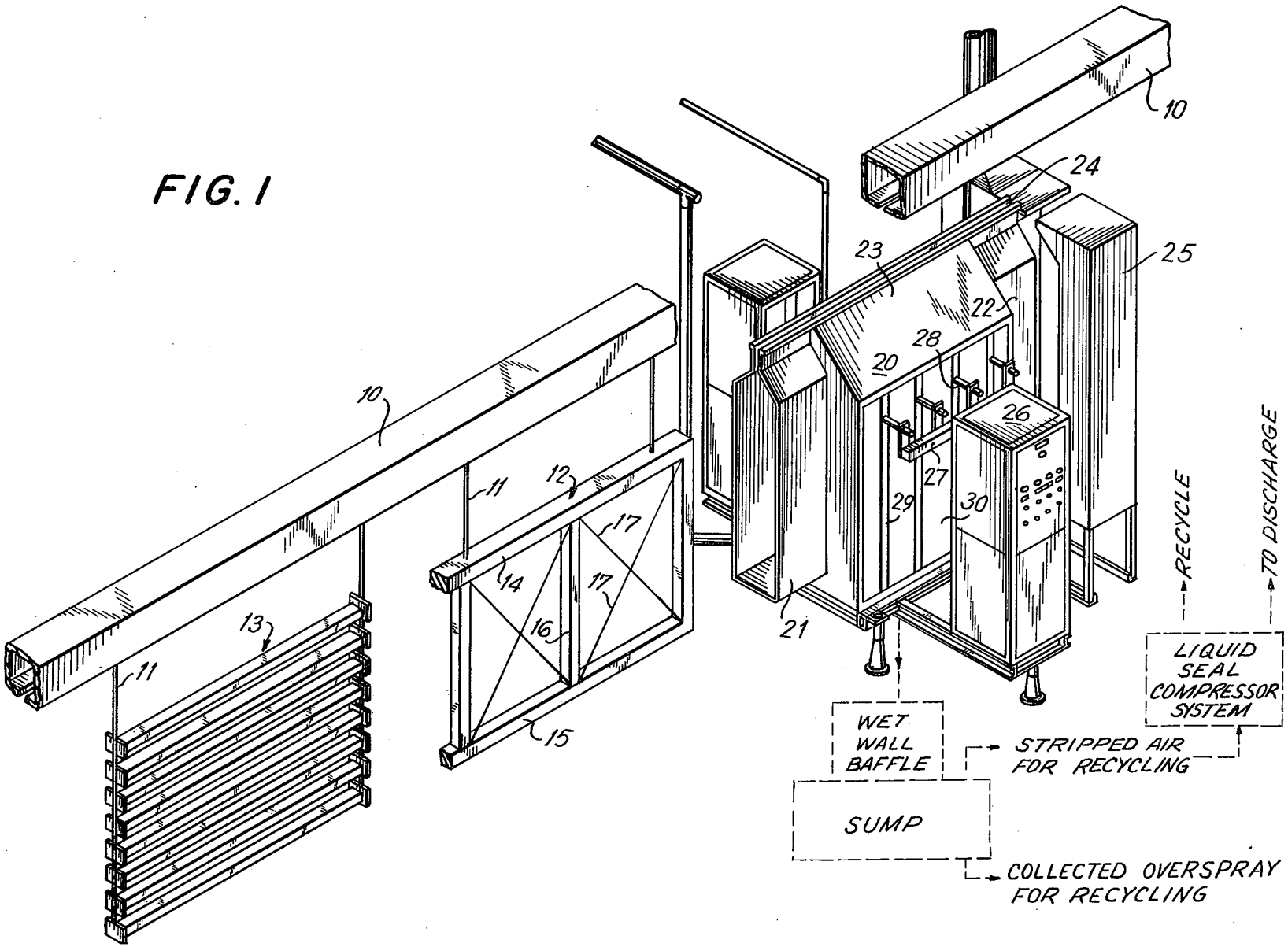
FIG. 1 is a simplified perspective view of a conveyerized spray coating line as constructed in accordance with the invention for the automated, non-electrostatic spray coating of randum, irregular parts.

Referring now to the drawings, FIG. 1 illustrates a typical commercial paint spray line incorporating the principles of the invention. An overhead conveyor, generally designated by the reference numeral 10 is arranged to receive hangers 11, from which are suspended parts 12, 13 to be painted. It is assumed, although not critcial to the invention, that the parts 12, 13 may be of non-uniform configuration, may have substantial percentages of open area, may have surfaces facing in various directions, and quite typically a combination of all of the foregoing. The part 12, for example, represents a typical open truss member, including upper and lower structural members 14, 15, which may be channel beams or box beams, vertical structural elements 16, and diagonal rod-like or wire-like elements 17.

A spray housing 20 is provided along the conveyor path, and it most advantageously includes an entrance vestibule 21, an exit vestibule 22 and a spray application chamber 23. In its generalities, the spray housing 20 is constructed in accordance with the principles indicated in the E. O. Norris U.S. Pat. No. 2,848,353, the disclosure of which is made a part hereof by reference. In the beforementiaoned E. O. Norris patent, the spray chamber is provided in its lower portion with a sump, which collects all of the liquid overspray draining down the chamber walls. The drainage flow from the sump is through a baffle-like structure, which also constitutes the sole or primary air discharge path from the chamber. The spray coating material is introduced into the chamber by means of air atomizing spray guns, such that substantial quantities of air are being introduced into the chamber continuously during a spray coating operation. By means of a suction device, connected through the baffled sump passages, all of this air is drawn out of the spray chamber, through the baffled sump, whose surfaces are wet with the outflowing liquid overspray. The spray mist, contained in the outgoing air, is caused to contact the wet baffle walls, which serve to extract most of the overspray mist entrained in the outflowing air. The liquid coating material is collected below the baffled discharge passage, adjusted as to proper viscosity if necessary, and reused. Desirably, the partially stripped air is then passed through a so-called liquid seal compressor system, as described in the beforementioned E. O. Norris (U.S. Pat. No. 2,848,353), which serves to strip any remaining coating material or solvent mist from the air. To a large extent, the stripped air may be recycled through the system, with a sufficient amount of clean, uncontaminated air being discharged through the atmosphere to maintain the entire spray chamber area at a slight negative pressure relative to ambient.

In the illustrated system, the spray chamber 20 and entrance and exit vestibules are provided with a continuous, elongated slot 24 at the top, to closely receive the hanger elements 11 extending from the conveyor. Because of the slight negative pressure within the chamber, there tends to be a slight air inflow through the slot 24, preventing the escape of solvent-laden air into the surrounding plant area. In addition, particularly where the openings to the entrance and exit vestibules must be relatively large in order to accommodate the parts desired to be coated, it may be appropriate to provide drift control hoods 25 adjacent each vestibule opening. In the system illustrated in FIG. 1, the drift control hood adjacent the entrance vestibule 21 is omitted for clarity. The drift control hoods are maintained under a slightly negative pressure, in order to draw in any solvent or mist-laden air which drifts from the vestibules 21 or 22, notwithstanding the negative pressure within the spray chamber 23. The drift control hood is particularly desirable for the exit side opening, because the part being moved through the spray housing by the conveyor may tend to push ahead of it a localized body of solvent or mist-laden air. The drift control hood on the exit end serves to gether up such air and prevent its escape into the surrounding plant area.

As shown in FIG. 1, along each side of the spray housing 20 is a reciprocator station 26. The reciprocator stations are conventional, commercially available units, each carrying a mounting bar 27 arranged to be reciprocated vertically, sometimes through a fixed stroke and sometimes through a stroke of variable height, depending on the particular type of reciprocator drive. In the illustrated system, the mounting bar 27 carries a plurality of spray arms 28, to be hereinafter described in more detail, which extend through vertical slots 29 in the side walls 30 of the spray housing. Typically, the slots 29 are provided with an appropriate, flexible closure seal (not specifically shown) such that the spray housing remains substantially closed while accommodating the necessary vertical travel of the spray arms. It will be understood, of course, that the principles of the invention are applicable to systems utilizing one or more reciprocator stations, and the reciprocator stations may utilize one or more spray arms 28. In a typical case, however, where it is desired to spray coat relatively large, continuously moving parts, it is advantageous to utilize more than one spray arm on a reciprocator, and it is usually desirable to provide a reciprocator on each side of conveyor paths, in order to permit the workpiece to be coated on opposite sides in a single path through the spray housing.

Figure 2:
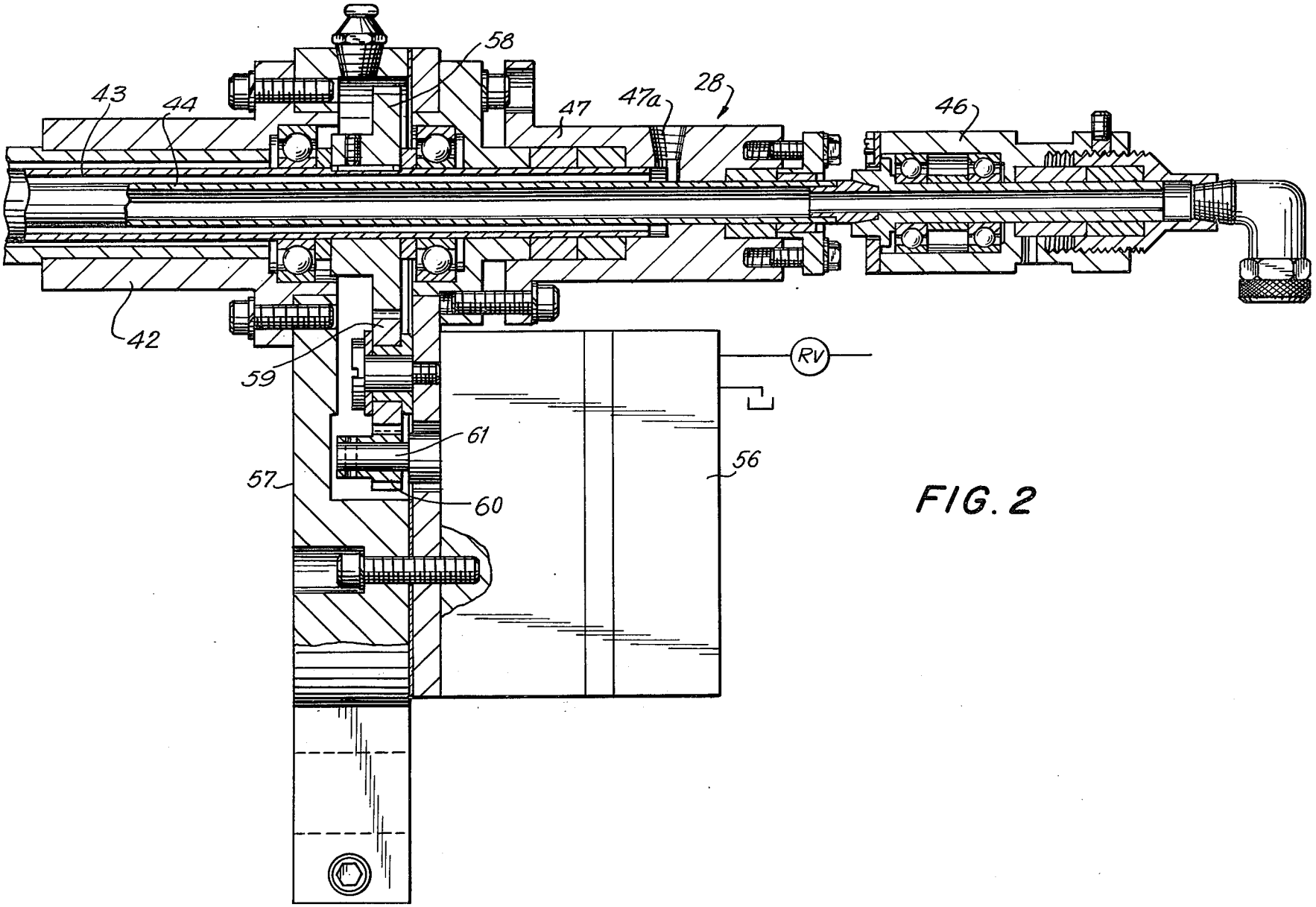
FIGS. 2 and 2*a* are elevational views, partly in cross section, showing a rotatably mounted spray head arrangement according to the invention.
Figure 2A:
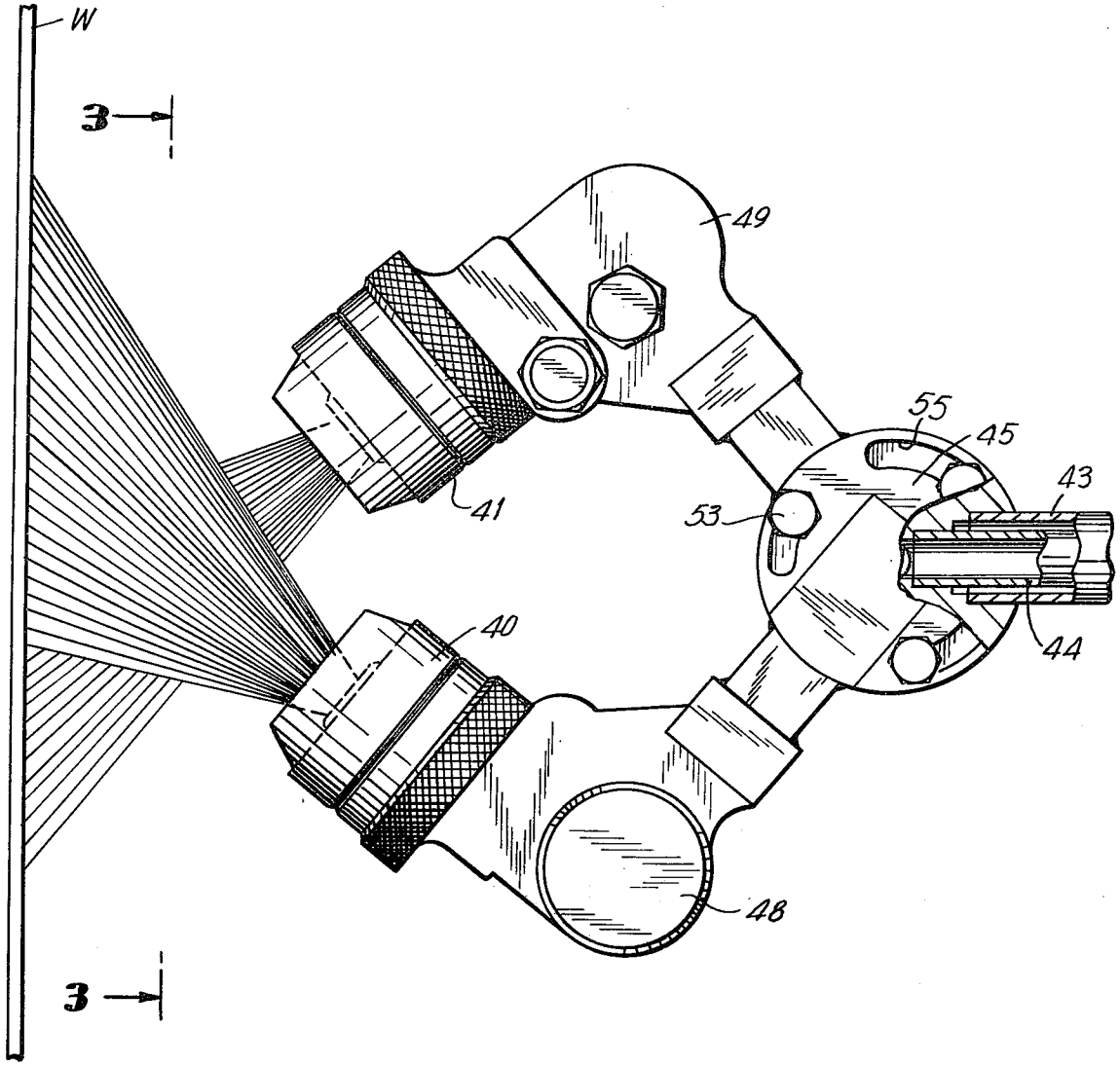

Pursuant to a significant aspect of the invention, the individual spray arms 28 are arranged for rotary motion, either unidirectionally, or in a oscillatory fashion. In conjunction therewith, and as shown particularly in FIG. 2, the spray arms 28 mount at their forward ends one or more spray nozzles — in the illustrated case a pair of nozzles 40, 41. In the arrangement of FIGS. 2, 2*a* the spray assembly includes a bearing housing 42 which rotatably supports a pair of concentric nozzle supply tubes 43, 44 leading to a manifold assembly 45 adjacent the spray nozzles 40, 41. The inner most tube 44 is connected at its rearward end to a rotary coupling assembly 46, arranged to be connected to a supply of coating material (not shown). The outer or surrounding tube 43 is likewise connected through a rotary coupling arrangement 47 to an air inlet port 47*a* arranged to be connected to a source of atomizing air (not shown). The respective supply tubes 43, 44 are connected to air and coating material passages in the nozzle heads 48, 49 on which the respective nozzles 40, 41 are mounted.

The spray nozzles 40, 41 are air-atomizing nozzles of well known, conventional design. These nozzles are arranged to discharge a stream of air-atomized coating material from a central aperture 50 (see FIG. 3). On opposite sides of the central aperture are horns 51 containing one or more air discharge openings 52 directed inward toward the axis of discharge of the coating material. Air jets emanating from the horn outlet passages 52 converge along the coating material discharge axis and serve to deflect and flatten the stream of atomized coating material. Thus, whereas the coating material normally tends to be discharged in a slowly expanding conical pattern, the converging air streams issuing from the horn apertures 52 serve to spread out and flatten to the spray, to form a wide, flat spray pattern.

Pursuant to one aspect of the invention, the orientation of the nozzle horns 51 is such that the principal planes of the flat spray fans of coating material lie generally crosswise to the direction of movement of the nozzles when rotated. Where the spray arm assembly 28 includes only a single spray nozzle, the principal plane of its spray fan may be aligned radially with the axis of rotation. Where more than one nozzle are employed, the principal planes of the respective spray fans may have to be offset somewhat, as reflected in FIG. 3, so that one spray fan does not substantially intersect with and interfere with the other. In such cases, the spray fans are displaced sufficiently from true radial alignment to maintain the fans in a substantially non-intersecting relationship, while still presenting a broad dimension of the spray fan to the direction of movement of the nozzles.

Figure 3:
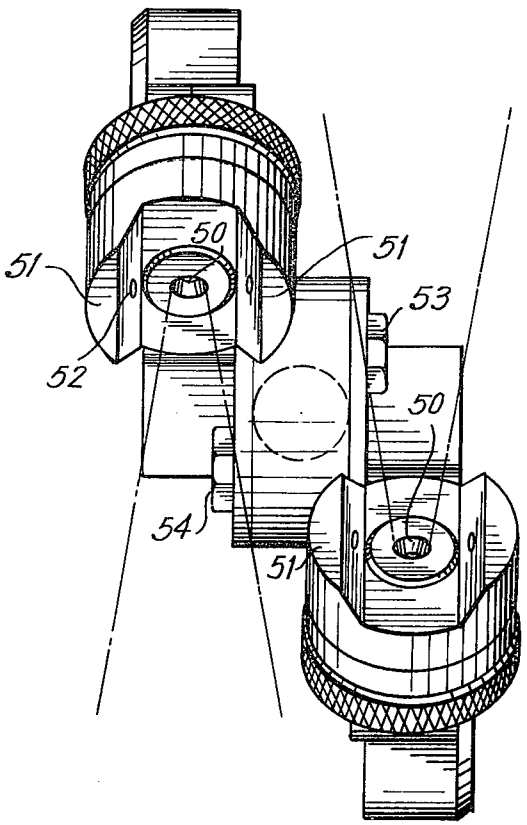
FIG. 3 is a front view of the spray head arrangement of FIG. 2*a*.

As shown in FIGS. 2*a* and 3, the manifold 45, which mounts the spray heads 48, 49 is adjustable within limits, by loosening bolts 53, 54 and moving the nozzle assemblies angularly, within the range determined by arcuate slots 55. As will be more fully described hereinafter, the angular disposition of the nozzle heads, relative to the axis of rotation, is significant to the invention, in combination with other parameters.

In the arrangement specifically illustrated in FIG. 2, the nozzle heads are arranged to be driven by a fluid motor 56 secured to a mounting arm 57, which carries the main rotary bearing 42 supporting the nozzle supply tubes 43, 44. A gear 58 is keyed to the outer supply tube 43 and is driven, through an idler gear 59, from a pinion 60 carried by the motor shaft 61. The fluid motor 56 is controlled by means of a regulator valve RV, which controls the pressure and/or volume of fluid flowing to the motor and this its speed of operation. As will hereinafter appear, the rate of rotation of the nozzle heads is correlated in a predetermined manner with the rate of vertical reciprocation and the rate of conveyor advancement, in order to achieve a desired pattern of spray application to the workpiece area.

In some cases, it may be desirable and advantageous to mechanically relate spray head rotation with reciprocator motion, as by mounting a suitable rack alongside the path of vertical reciprocation, for cooperation with a rotatable pinion carried with the vertically reciprocating nozzle heads. Vertical movement of the nozzle heads will then cause corresponding rotation of the pinion, which can be utilized to precisely correlate rotation of the nozzle heads. The use of such a rack and pinion arrangement, would of course be in place of the variable speed motor 56.

Figure 8:
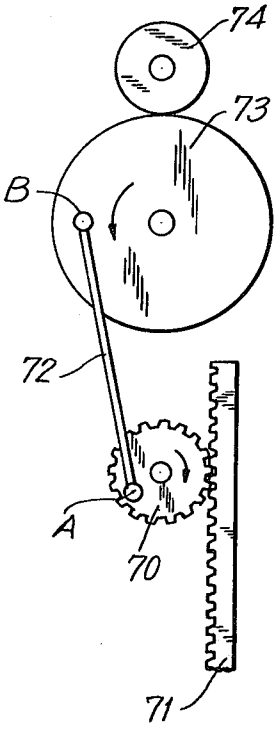
FIG. 8 is a simplified, schematic illustration of a drive arrangement for effecting reciprocating oscillation of spray nozzles.

While in the arrangement specifically illustrated in FIG. 2, the spray heads are arranged for unidirectional rotation, it is desirable and advantageous in some cases to reciprocate the spray heads through reversing rotary arcs. In such cases, the are of rotation desirably is substantially a function of 360° divided by the number of spray nozzles mounted on the nozzle head. FIG. 8 schematically illustrates an arrangement suitable for this purpose. There is shown in that FIGURE a drive element 70, which is arranged for unidirectional rotation. The element 70 can be connected to a drive motor, such as the motor 56 of FIG. 2, or it may be (or be conected to) a pinion meshing with a vertical rack 71 arranged alongside the vertical reciprocation path. In one case, the drive element 70 will rotate unidirectionally throughout, whereas in the other, the drive element will rotate in one direction during upward strokes of the reciprocator and in the opposite direction during downward strokes. The drive element 70 is connected through a suitable connecting link 72 to a rocker element 73, advantageously in the form of a gear. In the schematically illustrated arrangement, the connecting link 72 engages the drive element 70 at a point A which is located at a substantially smaller radius from its rotational axis than the point B at which the link engages the rocker element 73. Accordingly, thee maximum displacement of the link 72 by the drive element 70 is insufficient to fully rotate the element 73, and it merely rocks back and forth. A pinion 74 of appropriate size, driven by the rocker 73, translates the reciprocating motion of the rocker into a desired reciprocating arc (e.g., 180° for a two nozzle system, 90° for a four nozzle system, etc.).

One of the potential advantages of the reciprocating drive arrangement as illustrated in FIG. 8 is the ability to eliminate rotating seals. Rather, the spray tubes may be connected to approrpriately arranged flexible hoses capable of accommodating the reciprocating arcuate movements of the nozzle heads. While rotating seals are conventional and relatively reliable, solvent-based coating materials represent a particularly difficult environment for such rotating seals, because of the tendency for the coating material to harden up during periods of inactivity, which can result in premature leakage and messy conditions in the area of the spray booth.

In part, advantages are realized in the new system from an angular disposition of the spray nozzle heads with respect to the axis of rotation thereof. As a result, in the course of rotating through a full revolution, nozzles which are angled at, say, 45° to the rotational axis, will "look" at surfaces of the workpiece exposed in just about any direction which faces the nozzle heads. This feature, in conjunction with relative motion of the nozzle heads in relation to the workpiece, assures that virtually all of the surfaces of the workpiece will be exposed to the direct action of the spray fans in the course of the spray coating operation. In a crude form, some aspects of this technique are reflected in the Faber U.S. Pat. No. 3,386,415 and the Isaac U.S. Pat. No. 3,568,638. Both of these patents show rotating spray gun arrangements and, in the case of the Faber patent, workpieces are conveyed through the coating station past the rotating spray nozzles. However, in order to achieve commercially desirable coating results, at least for many spray painting applications, the application of a relatively uniform layer of coating material is significant, and is not achieved by merely providing for rotation of the spray nozzles relative to the workpiece. In this respect, where there is relative motion between their rotating nozzles and the workpiece, the pattern of spray application can be highly complex, and gross variations in coating uniformity may result, if certain parameters are not followed.

The process and apparatus of the present invention are intended for the spray coating of workpieces which are of a size and shape, in relation to the pattern of spray application by a set of nozzles rotating about a stationary axis, that the workpiece must be conveyed past the spray heads along one axis (referred to for convenience as the conveying axis) and the rotating spray heads must also be reciprocated along a second axis (hereinafter referred to for convenience as the reciprocation axis), typically disposed at rights angles to the conveying axis. The path traced by the center point of the spray fan (i.e., the intersection of the spray fan axis with a flat plane representing the workpiece) is a complex cycloid, which may be either prolate or curtate in form. The cycloid is prolate in form if, when the spray nozzle is unidirectionally rotated, the curve forms a loop upon itself during each rotational cycle. See, for example, FIGS. 4 and 9. A curve is curtate when the rate of relative motion between the rotating spray heads and the workpiece is sufficiently rapid as to prevent the spray axis from tracing a loop upon itself in the course of its rotations. See, for example, FIG. 10.

A cycloidal curve is generated by rotating a circle along a straight line and following the path of a given tracing point rotating along with the circle. When the tracing point lies on a radius less than that of the rolling circle, a curtate cycloid is generated. When the tracing point lies on a radius greater than that of the rolling circle, a prolate cycloid is generated. Although in the system of the present invention, a rolling circle is not literally rolled along a straight line, the rotation of the nozzle heads, in conjunction with a resultant linear translational movement of the nozzle heads with respect to the work, traces a cycloidal curve which is equivalent to a theorectically generated cycloid having a rolling circle radius "*a*" and a tracing point radius "*b*". Thus, it is possible to express the cycloidal curve generated by the spray axis of a rotating nozzle, during reciprocation relative to the conveyed workpiece, as having an equivalent radius ratio of *a/b*.

Figure 4:
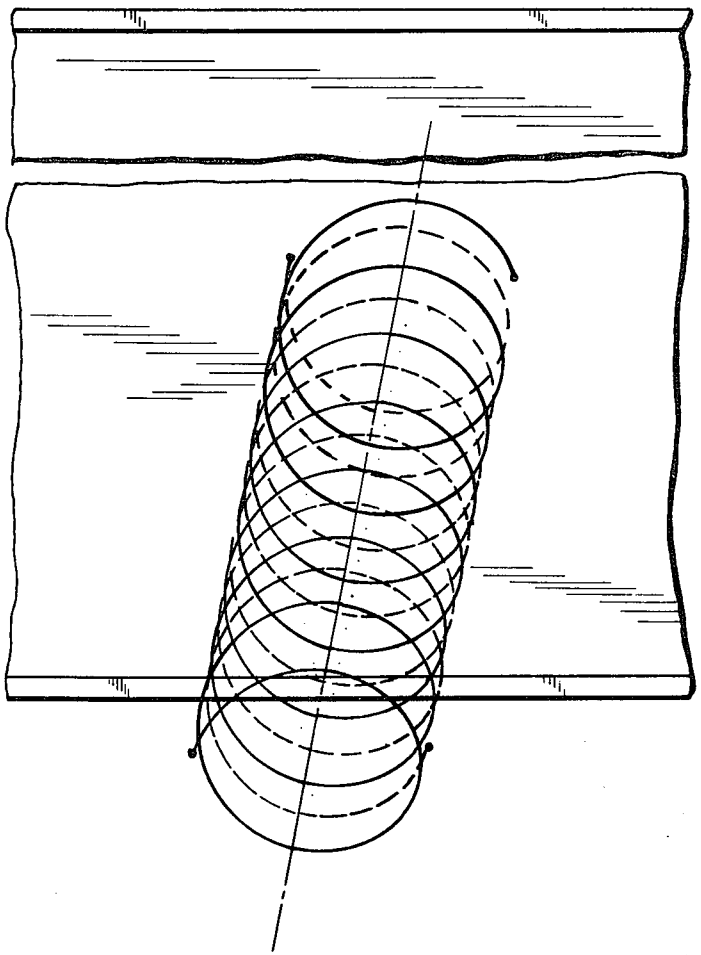
FIG. 4 is a schematic illustration of a typical tight prolate cycloid pattern of spray application achieved in accordance with the teachings of the invention, illustrating the path of the center point of the spray fan.

Pursuant to one of the aspects of the invention, I have found that, in order to achieve consistently acceptable results in terms of quality of coating uniformity, the spray must be applied in the form of a tightly closed prolate cycloid which, for the purpose of this invention, may be defined as a prolate cycloid having an *a/b* ratio of one-to-five or greater. In other words, when the rolling radius "*a*" is one unit, the tracing radius "*b*" should be five or more units. By way of specific example, the tightly closed prolate cycloid curve illustrated in FIG. 4 reflects a ratio of rolling radius to tracing radius of approximately one to ten, which experience has shown to be highly satisfactory for most applications. In the illustration of FIG. 4, the curves reflect an upward reciprocation of the rotating spray nozzles in conjunction with a right-to-left movement of the workpiece. While the actual reciprocation axis is vertical, the effect of the simultaneous horizontal motion of the workpiece is to effectively cant the reciprocation axis relative to the work. The solid lines in FIG. 4 reflect the path traveled by the spray axis of one of the nozzles of a pair, with the broken line reflecting the path traveled by the second spray axis. The paths are as traced by the intersection of the spray axis on a flat plane, as will be understood.

As is clearly evident in FIG. 4, using an *a/b* ratio on the order of 1/10, the prolate cycloid forms a large, almost circular loop on itself during each revolution, with the rate of translational advancement along the resultant axis being substantially less than the width of the loop. The indicated spray path configuration, in the overall context of the invention, as herein set forth, provides for a highly uniform spray application to the workpiece.

Figure 9:
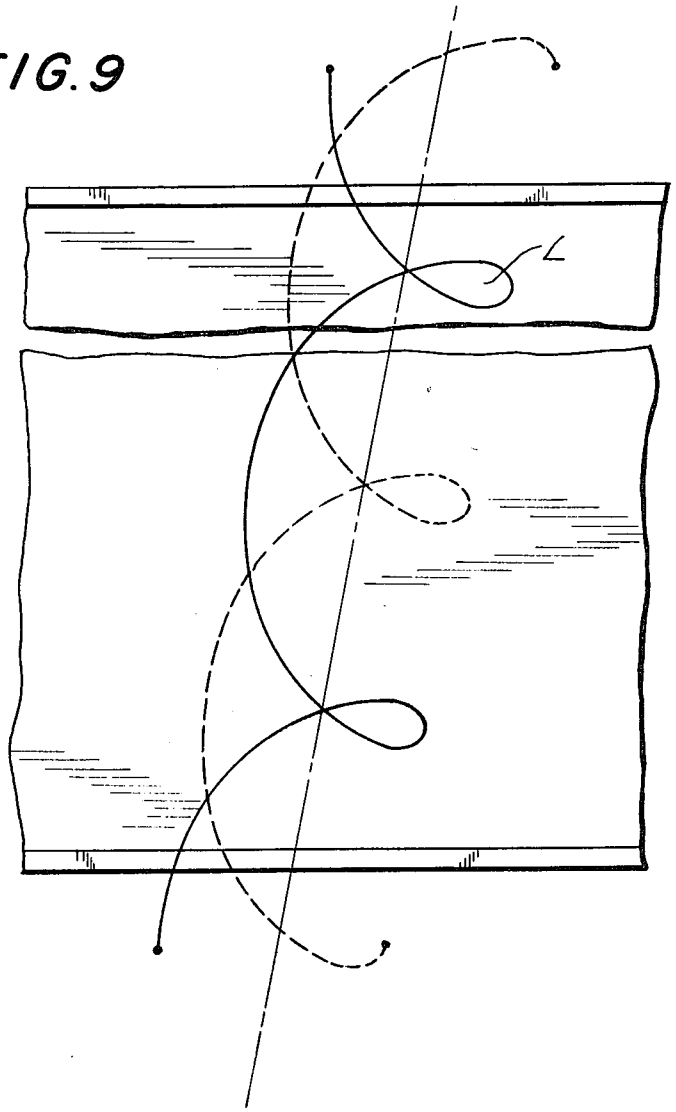
FIGS. 9 and 10 are illustrative of the mean path of a pair of spray fans in which, contrary to the invention, the relationship of rotation to translation to radius of an intercept is such as to generate a wide open prolate cycloid (FIG. 9) and a curtate cycloidal (FIG. 10) path of spray fan application.

In contrast to FIG. 4, the spray pattern reflected in FIG. 9, while still a prolate cycloid, has an *a/b* ratio on the order of 1/2. As will be apparent upon inspection of FIG. 9, the loop areas L of the cycloid have a very small width in relation to the per-cycle linear translation of the path. As a result, there is an overly heavy and concentrated application of the spray material in the area of the loop, and a contrastingly thin application of the spray material along the long sweeping arc of the path which connects successive loops. Thus, even though the workpiece might be traversed a sufficiently large number of times to completely coat the workpiece, the result would be considered unsatisfactory as being signifcantly nonuniform area to area or else too heavily coated with the spray material, or perhaps both. In the curve of FIG. 9, which can be descriptively referred herein as an open prolate cycloid, the solid and broken lines represent the spray axis path of a pair of opposed spray nozzles. It will be observed that the addition of more nozzles does not improve the matter of nonuniform spray application, because the additional nozzles will simply add additional tightly closed loops along the reciprocation path, with each of the loops representing an area of heavily concentrated spray application which, in the finished product, will have the appearance of a pronounced spot, in relation to the less heavily coated areas.

Figure 10:
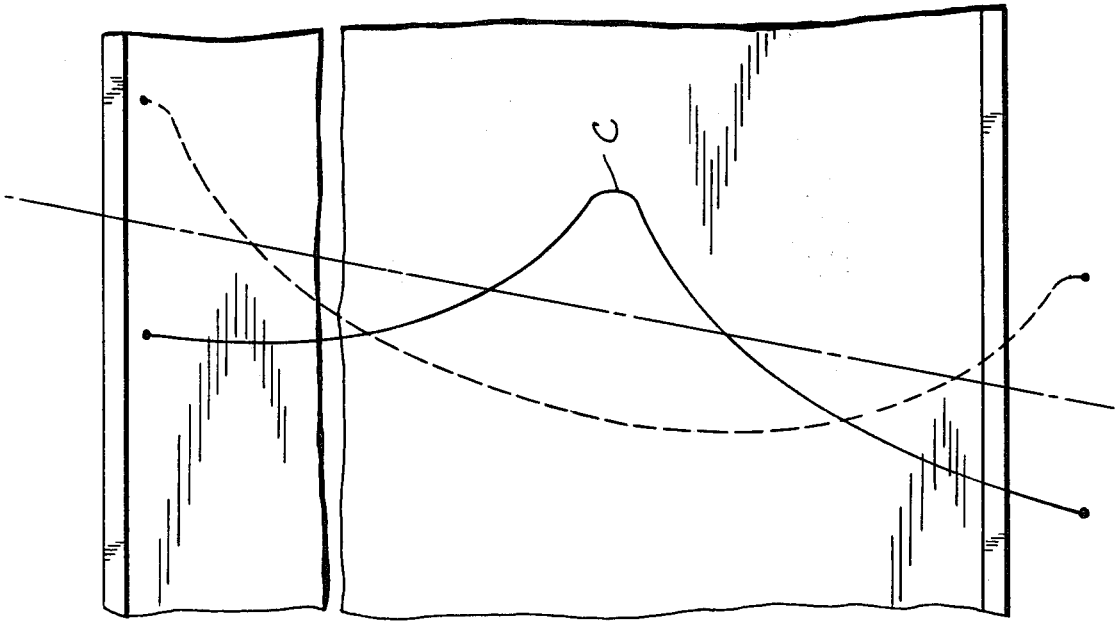

In FIG. 10, there is illustrated a typical pattern of spray application, in which the *a/b* ratio of the cycloidal curve is on the order of seven-to-six. In this case, the theoretical rolling radius exceeds the tracing point radius, and a curtate cycloid results. Although, in the curtate cycloid, the curve does not form a loop upon itself, it does tend to form a cusp area C, which is an area in which there is a substantially reduced relative motion between the spray fan axis and the workpiece, resulting in a heavy application of the coating material as compared to the long-sweeping arc areas of the curve, in which the spray fan is traveling at a relatively high rate of speed. Likewise, with the curtate cycloidal curve form, there are relatively few rotations of the nozzle heads per unit of lineal travel, greatly increasing the chances of missed or insufficient coverage of irregular areas.

Figure 5:
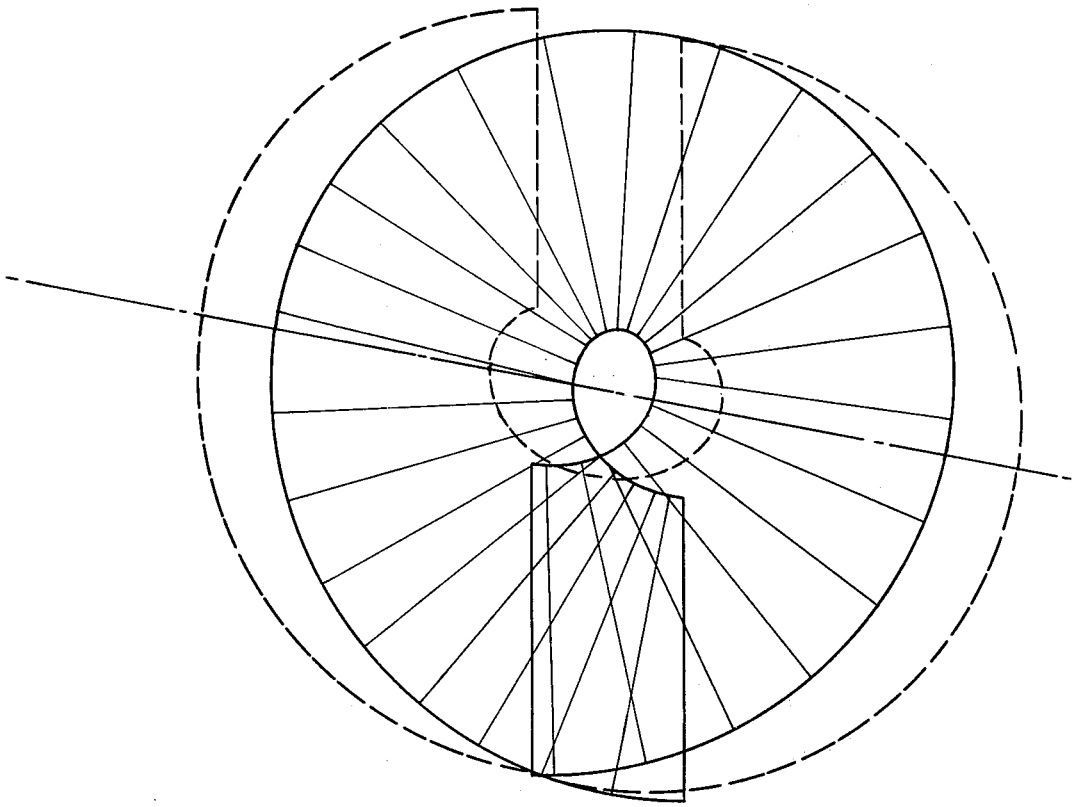
FIG. 5 is a schematic illustration, somewhat similar to FIG. 4, illustrating the pattern of application of a full-width spray fan when advanced along a tight prolate cycloid path as provided by the teachings of the invention.

In FIG. 5 of the drawing, there is schematically illustrated a pattern of spray application resulting from the rotation of a pair of angularly disposed spray nozzles arranged according to the invention and translated along the workpiece in such manner as to provide an equivalent ratio of rolling radius to tracing point radius (*a/b*) of about 1-to-10. The arrangement of FIG. 5 is illustrative of a two nozzle configuration, substantially as shown in FIG. 2*a*, in which the spray fan intercept on a flat workpiece, disposed at right angles to the axis of rotation, is about eight inches in width, with the inner extremity being spaced about 2 inches from the rotational axis and the outer extremity being spaced about 10 inches from the rotational axis, providing for an intersection of the spray fan axis at about 6 inches from the axis. In FIG. 5, the solid lines represent a single sweep of one of the spray fans, while the broken lines represents a single sweep of the other spray nozzle. In general, the nozzles are arranged so that the respective spray fans are more or less radially disposed, it being understood that some amount of offset is provided if the spray fans cross, to prevent interference.

In the arrangement of FIG. 5, the tracing point of the center of the fan (i.e., the spray axis) would trace a tightly closed prolate cycloid, substantially as shown in FIG. 4. Over the entire width of the fan, the form of the curve will, of course, vary somewhat, being even more tightly closed at the outer extremities, and being somewhat more open (*a/b* ratio of around 1-to-3) at the intermost extremities. Although each sweep of the nozzles in FIG. 5 leaves a small open area in the center, these are successively coated over as the nozzle heads are reciprocated over the workpiece area.

Figure 7:
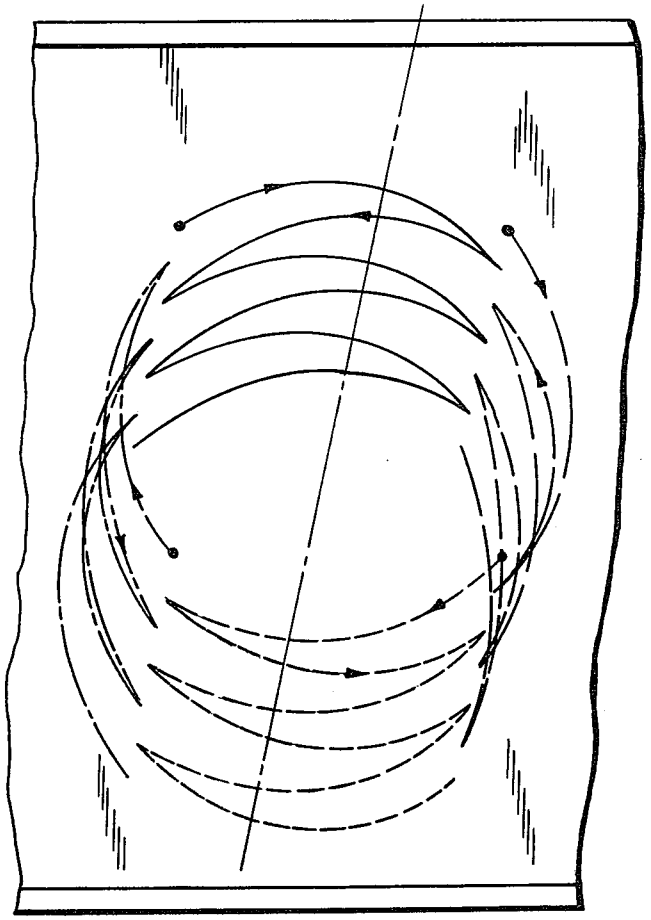
FIG. 7 is a schematic illustration, similar to FIG. 5, illustrating the use of four equally spaced nozzles, oscillated through arcs of 90° in both directions.
Figure 6:
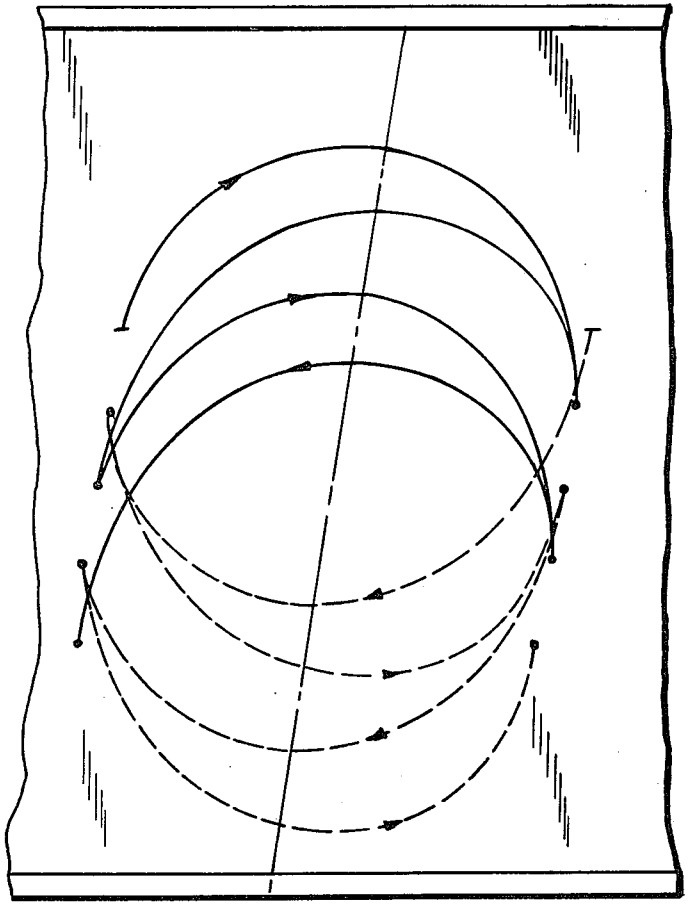
FIG. 6 is a schematic illustration of a typical pattern of spray application achieved in accordance with the teachings of the invention, illustrating the use of a pair of spray fans oscillated through 180° arcs in both directions rather than being rotated unidirectionally.

FIGS. 6 and 7 illustrate spray application curves which, although similar in many respects to the curve of FIG. 4, have important differences. Thus, in FIG. 6, there is shown a two nozzle spray head configuration, in which the rate of rotation in relation to the rate of translational movement provides for an equivalent ratio of rolling circle radius to tracing point radius (*a/b*) of around 1-to-10 — the same as for FIG. 4. However, as an important difference, the nozzle heads are not unidirectionally rotated, but are rotated 180° in a first direction and then 180° in the reverse direction. The effect of the reciprocatory rotational movement of the arrangement of FIG. 6 is to repetitively reverse the inherently asymmetrical aspects of the cycloidal curve. In other words, as is immediately evident in FIG. 9, the character of the curve is dramatically different on one side of the reciprocating axis than on the other, resulting from the fact that reciprocation and rotational movements augment each other on one side of the axis but are subtractive on the opposite side. This is true even in the curve of FIG. 4, although to a less obtrusive extent. By repetitively reversing the rotational movement of the nozzles, the augmenting and subtracting aspects of the reciprocation and rotational motions are repetitively reversed from one side of the axis to the other, which can result in improved uniformity of spray application in some instances.

The illustration of FIG. 7 contemplates a nozzle head assembly including four spray nozzles spaced at 90° and rotated in a reciprocatory fashion through arcs of about 90°. The representative curve of FIG. 7 has an equivalent ratio of rolling circle to tracing point (*a/b*) of about 1-to-10.

One of the significant advantages of the arrangement of FIGS. 6 and 7, is that, since the nozzles are not unidirectionally rotated, the fluid supplies to the nozzles may be provided by flexible fluid lines with fixed connections, rather than through rotating fluid seals. Elimination of the rotating fluid seals provides for significant economies in the cost of the installation, and also reduces maintenance problems.

A significant consideration in any of the various aspects of the invention is the positioning of the nozzles, in relation to the workpiece, such that, on the average, the desired relationships of effective rolling radius to effective tracing point radius are achieved. Thus, two factors must be taken into consideration in combination: First, the desired angularity of the nozzles with respect to the rotational axis, in order to permit the spray fans to "see" all of the surfaces of the workpiece; second, the positioning of the nozzles must be such, in relation to their spacing from the workpiece as to enable the spray fan axis to intercept the average plane of the workpiece surfaces at a radius from the axis of rotation which, in conjunction with the rate of translational movement of the rotating nozzle heads, will provide the desired *a/b* relationship of about one to at least five.

With typical, commercially available spray equipment, certain practical limitations may have to be observed with respect to nozzle placement, in order to achieve a desired spray fan intercept on the workpiece, considering the matter purely from the standpoint of desirable spray coating practice. Thus, in a typical case, the spray nozzles likely might be comprised of a Binks 63A fluid tip, in conjunction with a Binks 63P air cap. With such nozzle arrangements, it is desired to have the spray fan intercept the work surface at around eight inches or so from the nozzle, in order that the spray fan be neither too widely dispersed nor too closely concentrated. Thus, in a typical case, nozzle angularity and positioning must take into account distance of the nozzle from the workpiece average surface. In some instances, this can involve a positioning of the nozzles at a location removed from the rotational axis, with the spray fan being directed back toward the axis. In the specific illustration of FIG. 2*a*, the respective nozzle assemblies 40, 41 are arranged to project spray fans in crossing relation, from one side of the rotational axis to the other. In many cases, and particularly where several spray nozzles are mounted on each rotating spray head assembly, it is advantageous to arrange the nozzles in a diverging or "Y" configuration.

The specific angular orientation of the spray nozzles may be influenced somewhat by the specific nature of the work. While a 45° orientation may provide for an optimum average orientation, capable of reaching with similar effectiveness surfaces which are both parallel to and at right angles to the axis of rotation, particular workpieces, having unusual surface configuration, may suggest other orientations. Thus, while a 45° orientation may be optimum for the coating of flanged beams, such as large structural I-beams, tapered flanged beams and the like, other structural elements, including channel beam components, for example, may suggest a nozzle orientation of 60° or so to the rotational axis, in order to penetrate deep into the recesses of the channel beams. In this respect, where there are several individual nozzles on a rotating assembly, one nozzle may be oriented at a different angle than another, as long as rotational balance is not unduly upset. Where, as shown in FIG. 1, a reciprocator includes a plurality of spray arm units, the nozzles of different spray arms may be set at somewhat different angles, in order to provide coverage to a wide variety of surface irregularities.

The present invention has provided an outstandingly superior technique for the automatic spray coating of irregularly shaped parts, particularly where the parts are of a random nature, as would be typical of the production of a custom fabrication plant, for example. The invention provides for the reciprocation of rotating, angularly disposed spray nozzles, with respect to a moving workpiece, such that virtually any surface of the workpiece is effectively coated with the spray material in a highly uniform and commercially acceptable manner. This is achieved, in accordance with the present invention, by utilizing equivalent rolling circle radius to tracing point radius values of one to at least five. The achievement of this equivalent geometrical relationship requires a correspondence of nozzle positioning, nozzle angularity, nozzle spacing from the workpiece, rate of rotation of the nozzles, rate of reciprocation of the nozzle mounting and rate of conveyor movement of the workpiece. Variations in any one of these will change the equivalent $a/b$ ratio of the spray pattern, and all factors must be taken into consideration in a given production operation, in order to achieve the desired quality of results.

Quite independently of the geometrical considerations discussed in the preceding paragraph, important advantages are to be derived from the use, in conjunction with a rotating, reciprocating spray head installation for a conveyed workpiece, of an effectively enclosed spray chamber provided with facilities according to the beforementioned E. O. Norris U.S. Pat. No. 2,848,353, for the collection and recycling of overspray. This aspect of the invention contemplates that the workpiece is large, irregular, and perhaps of a very open nature. Insofar as this aspect of the invention is concerned, spray coating of the workpiece will involve reciprocating the spray nozzles from limit positions which are above the upper extremity of the workpiece (permitting the rotating nozzles to spray downward on its upper surfaces) to below the lower extremities of the workpiece (permitting the rotating nozzles to spray upward against the bottom surfaces of the workpiece). Likewise, the spraying operation, if not continuous, will commence at a point prior to the workpiece being advanced to the axis of spray nozzle rotation, and will continue until the workpiece has gone beyond the axis of spray nozzle rotation, in order that the spray nozzles will have an opportunity to "see" and apply coating material to the leading and trailing edges of the part. These factors, in conjunction with the fact that the conveyed part may have irregular vertical and horizontal dimensions and/or substantial open areas, provide inherently for an extremely large amount of overspray. Thus, the automatic spray coating of such irregular and/or open workpieces by the use of rotating, reciprocating spray nozzles would be commercially impracticable in the absence of effective recovery and recycling of the overspray, as by the wet wall baffle system of the E. O. Norris U.S. Pat. No. 2,848,353.

As will be readily appreciated, the specific forms of the invention herein illustrated and described are representative only, as certain variations may be made therein without departing from the clear teachings of the disclosure. Accordingly, reference should be made to the following appended claims in determining the full scope of the invention.

I claim:

1. A process for spray coating of irregularly shaped articles, which comprises a. progressively conveying the articles along a conveying axis through a substantially enclosed spray chamber, b. directing one or more spray fans of coating material toward said article, c. rotating said spray fans about a rotational axis disposed at a large angle to the conveyance axis, d. said spray fans being directed at a substantial angle with respect to the axis of rotation thereof, e. reciprocating said spray fans along a reciprocation axis at a substantial augle to said conveying axis, f. said spray fans being rotated at a rate such, in relation to the speed of reciprocation and the speed of conveyance, that said spray fans described tight prolate cycloids in which the effective ratio of rolling circle radius to tracing point radius ($a/b$) is 1 to at least about 5.

2. The process of claim 1, further characterized by a. said spray fans being rotated unidirectionally.

3. The process of claim 1, further characterized by a. said spray fans being rotated in a oscillatory manner.

4. The process of claim 3, further characterized by a. said spray fans being rotated through an angle which is substantially 360° divided by the number of spray fans.

5. The process of claim 1, further characterized by a. said spray fans being divergently related to said rotational axis.

6. The process of claim 1, further characterized by a. said spray fans being arranged in crossing but substantially non-interfering relation.

7. A process for spray coating of irregularly shaped workpieces, which comprises a. rotating one or more spary fans of coating material about a rotational axis, b. said spray fans being oriented at a substantial angle to the rotational axis, c. conveying a workpiece along a predetermined conveying axis past said axis of rotation, d. reciprocating said axis of rotation across said conveying axis, and e. so relating the speeds of rotation, conveyance and reciprocation, in conjunction with the location of the intercept of the spray fans with the workpiece, as to cause the central axis of said spray fans to trace across the workpiece a path in the nature of a tightly closed prolate cycloid whose effective ratio of rolling circle radius to tracing point radius is 1 to at least about 5.

8. The process of claim 7, further characterized by a. there being at least two spray fans related divergently with respect to said axis of rotation.

9. The process of claim 7, further characterized by a. reciprocating said axis of rotation from a position below the lower edge of said workpiece to a position above the upper edge thereof while maintaining said spray fans.

10. The process of claim 1, further characterized by
a. said spary fans comprising air-shaped fans of air atomized liquid coating material,
b. confining said spray fans substantially to an enclosed spray chamber area,
c. withdrawing the liquid overspray through a baffle system,
d. withdrawing air from said chamber through said baffle system, in contact with said liquid overspray, and
e. re-cycling at least a substantial part of said air and overspray.

11. A process for spray coating of irregularly shaped articles, which comprises
a. rotating at least one spray fan of atomized coating material about a predetermined rotational axis,
b. said spray fan being oriented at a substantial angle to said axis,
c. said spray fan comprising a shaped fan of air-atomized material,
d. relatively moving said rotational axis and said workpiece whereby, in the course of coating said workpiece, said axis of rotation at one or more times lies outside of the workpiece perimeters, in front of the leading edge, behind the trailing edge, above the upper edge and below the lower edge, whereby to apply coating material to all of said edges during the course of spray fan rotation, and whereby substantial amounts of overspray are generated,
e. substantially confining said spray fans to a predetermined spraying zone,
f. causing the overspray liquid from said spraying zone to be drained through a wet wall baffle system and into a sump for recycling,
g. withdrawing air from said spraying zone through said wet wall baffle system whereby to substantially strip overspray mist from said withdrawn air,
h. withdrawing said air in amounts sufficient to maintain said spraying zone at a negative pressure relative to ambient, and
i. recycling at least some of said withdrawn air.

12. The process of claim 11, furthter characterized by
a. the angular orientation of said spray fan relative to said axis of rotation, the radius from said axis of the spray fanworkpiece intercept, and the rate of spray fan rotation being such, in relation to the rate of relative moving of said axis and workpiece, that said spray fan describes a path related to a prolate cycloid whose ratio of rolling circle radius to tracing point radius is 1 to at least about 5.

13. The process of claim 11, further characterized by
a. said workpiece being conveyed horizontally through said spraying zone, and
b. said rotational axis being reciprocated vertically between limit positions above and below said workpiece.

14. The process of claim 11, further characterized by
a. there being two or more spray fans arranged for rotation in unison about a common rotational axis,
b. said spray fans being arranged in a "Y" configuration to issure divergently related sprays.

15. The process of claim 11, further characterized by
a. said spray fans being rotated in a oscillatory manner.

16. The process of claim 15, further characterized by
a. there being one or more spray fans rotated in oscillatory fashion about one or more axes,
b. said spray fans, at least in combination, being operative to cover effectively a total of about 360° of rotation.

17. The process of claim 7, further characterized by
a. said spray fans comprising air-shaped fans of air atomized liquid coating material,
b. confining said spray fans substantially to an enclosed spray chamber area,
c. withdrawing the liquid overspray through a baffle system,
d. withdrawing air from said chamber through said baffle system, in contact with said liquid overspray, and
e. re-cycling at least a substantial part of said air and overspray.

* * * * *

UNITED STATES PATENT AND TRADEMARK OFFICE

CERTIFICATE OF CORRECTION

PATENT NO. : 4,042,734

DATED : August 16, 1977

INVENTOR(S) : RICHARD F. WIGGINS

It is certified that error appears in the above-identified patent and that said Letters Patent are hereby corrected as shown below:

In the ABSTRACT, line 19, delete "prolate" and insert --curtate--.

Column 2, lines 3, 32, delete "prolate" and insert --curtate--.

Column 3, lines 7, 12, 29, delete "prolate" and insert --curtate--,
line 30, delete "curtate" and insert --prolate--,
line 41, delete "critcial" and insert --critical--,
line 58, delete "beforementiaoned" and insert --beforementioned--.

Column 7, lines 39,40,54, delete "prolate" and insert --curtate--,
lines 39,43,52, delete "curtate" and insert --prolate--.

Column 8, lines 2,3,7,24,33,48, delete "prolate" and insert --curtate--,
lines 63,64, delete "curtate" and insert --prolate--.

UNITED STATES PATENT AND TRADEMARK OFFICE

CERTIFICATE OF CORRECTION

PATENT NO. : 4,042,734

DATED : August 16, 1977

INVENTOR(S) : RICHARD F. WIGGINS

It is certified that error appears in the above-identified patent and that said Letters Patent are hereby corrected as shown below:

Column 9, line 3, delete "curtate" and insert --prolate--,
line 32, delete "prolate" and insert --curtate--.
Column 12, line 21, delete "augle" and insert --angle--,
lines 25, 58, delete "prolate" and insert --curtate--.
Column 14, line 7, delete "prolate" and insert --curtate--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*